United States Patent [19]

Collaud et al.

[11] 4,207,032

[45] Jun. 10, 1980

[54] GAS-FIRED CIGARETTE LIGHTER

[75] Inventors: Jean-Michel Collaud; Albert Girella; Maurice Herren; Niklaus Muller; Roger Piola, all of Geneva, Switzerland

[73] Assignee: Fabrique Suisse de Crayons Caran d'Ache S.A., Thonex, Switzerland

[21] Appl. No.: 857,083

[22] Filed: Dec. 2, 1977

[30] Foreign Application Priority Data

Dec. 10, 1976 [CH] Switzerland ..... 15540/76

[51] Int. Cl.[2] ..... F23Q 25/00

[52] U.S. Cl. ..... 431/150; 431/344; 431/276; 137/630.22; 141/293; 220/20.5

[58] Field of Search ..... 431/344, 150, 130, 255, 431/254, 277, 276, 331; 141/237, 302, 349, 293; 137/264, 630.22; 220/20.2

[56] References Cited

U.S. PATENT DOCUMENTS

| | | | |
|---|---|---|---|
| 2,470,710 | 5/1949 | Mason | 67/7.1 |
| 2,533,806 | 12/1950 | Holzappel | 220/20.2 |
| 2,986,162 | 5/1961 | Spexarth | 137/264 |
| 3,169,804 | 2/1965 | Bueler et al. | 137/630.22 |
| 3,208,244 | 9/1965 | Mandy | 141/293 |
| 3,227,182 | 1/1966 | Garman | 137/630.22 |
| 3,516,775 | 6/1970 | Rabe | 431/344 |
| 3,516,776 | 6/1970 | Dieterle et al. | 431/344 |
| 3,899,286 | 8/1975 | Lockwood et al. | 431/321 |
| 3,921,665 | 11/1975 | Lebzelter | 137/630.22 |

FOREIGN PATENT DOCUMENTS

| | | |
|---|---|---|
| 2318706 | 4/1973 | Fed. Rep. of Germany . |
| 2341502 | 8/1973 | Fed. Rep. of Germany . |

*Primary Examiner*—Samuel Scott
*Assistant Examiner*—Wesley S. Ratliff, Jr.
*Attorney, Agent, or Firm*—Young & Thompson

[57] ABSTRACT

The invention relates to a gas-fired cigarette lighter comprising a gas reservoir, a gas distributor valve and means which make it possible to ignite the gas emerging from this distributor valve, comprising at least one reserve supply of gas and means for draining this reserve supply into the gas reservoir. This lighter is remarkable in that it is rechargeable and comprises a filling device enabling simultaneous filling of the reserve supply and of the gas reservoir, the filling device comprising two serially disposed valves, opening of the valve situated between the reserve supply of gas and the other valve being operated either by the opening of this other valve or by an operating element, this other valve then remaining closed.

16 Claims, 11 Drawing Figures

FIG.1
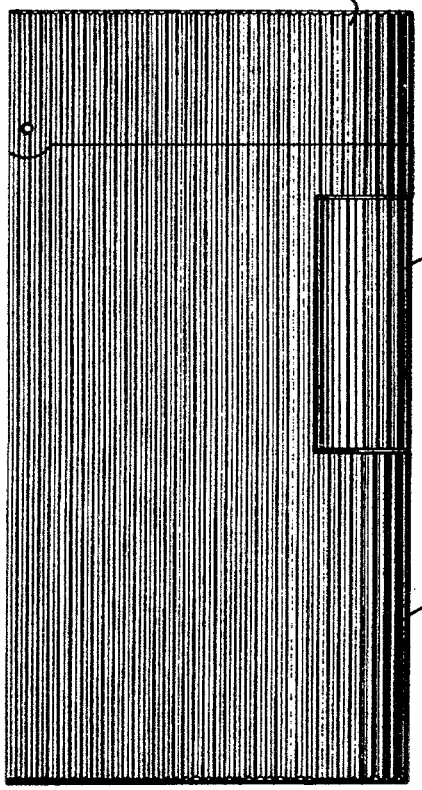
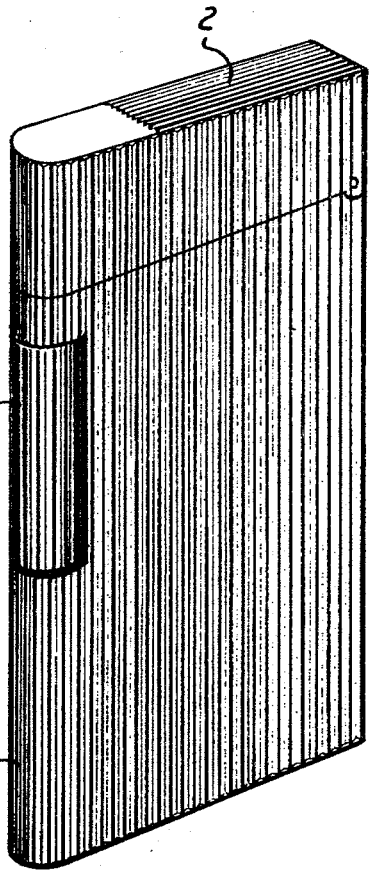
FIG.2

2.
12
13
1a
19
18
17
6
5a
29
28
11
16
15
14
1
30
31
32
9
5.
35
8
3
33
1
34.
4.
10
7
35.

34.
35
51
1
52
4.
53
54
45
47.

50
49
48
46
69
62
64
61
64
68
56
60a
41
63
60
57
55
59.
40.
70
58
61.
71
65
66
38
39
72
44.

GAS-FIRED CIGARETTE LIGHTER

The present invention relates to a gas-fired cigarette lighter comprising a gas reservoir, a gas distributor valve and means making it possible to ignite the gas emerging from this distributor valve, characterised in that it comprises at least one reserve supply of gas and means of emptying this reserve supply into the gas reservoir.

The accompanying drawings diagrammatically and by way of example illustrate an embodiment of the gas-fired cigarette lighter according to the invention. In the drawings:

FIG. 1 is a side view of the lighter;

FIG. 2 is a perspective view of the embodiment;

Figure 3:
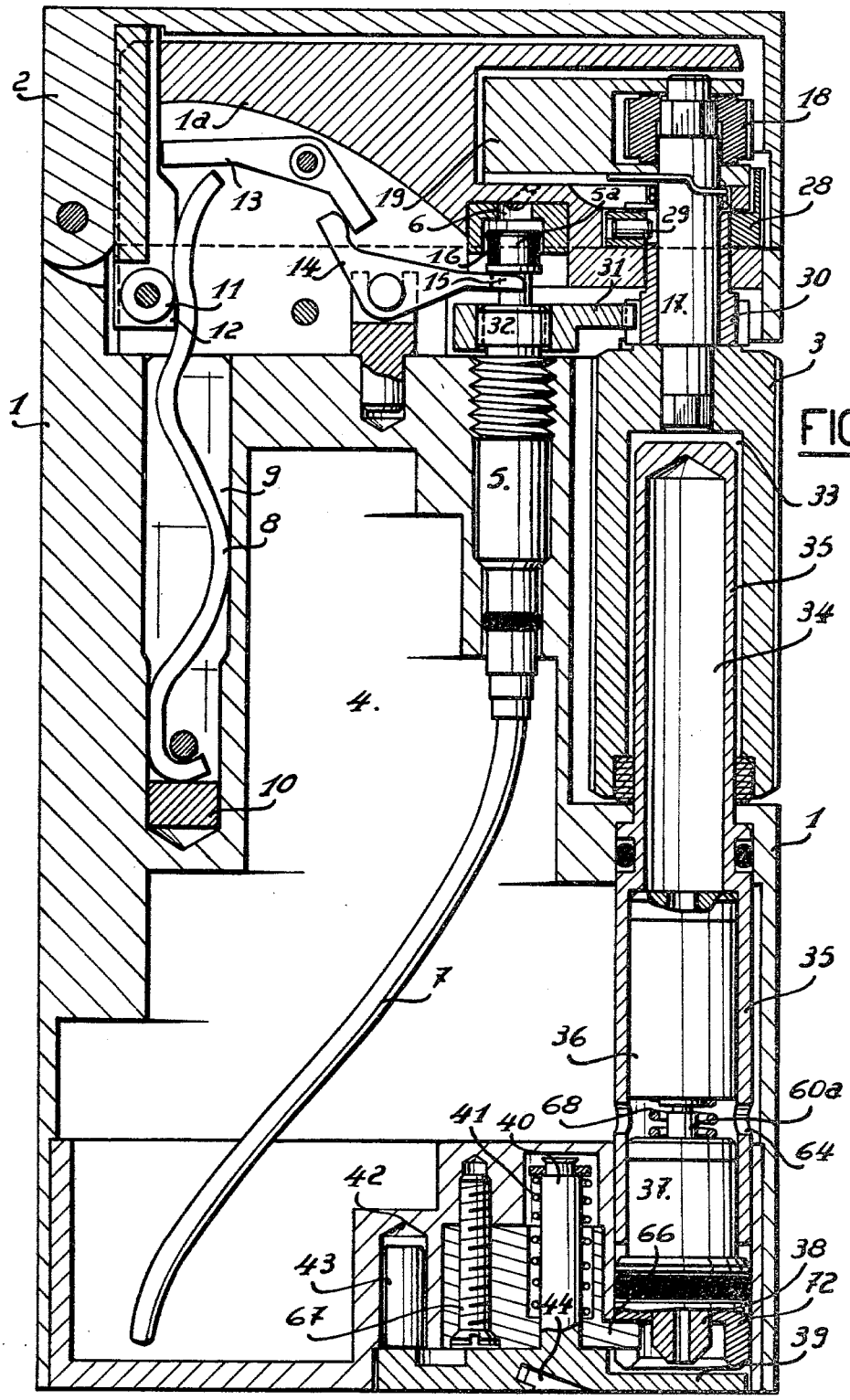
FIG. 3 is, on a larger scale, a cross-section through a first embodiment of the cigarette lighter, through the axis of the roller, the axis of the burner and the axis of the cover locking device.
Figure 10:
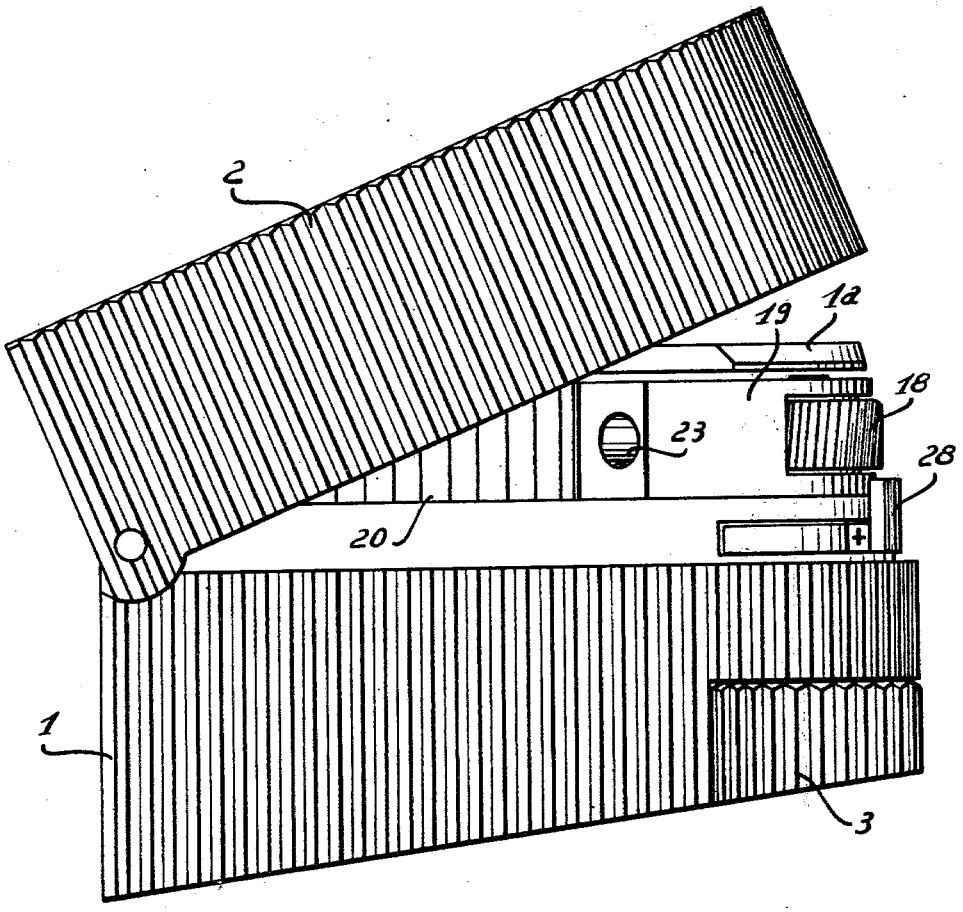
Figure 11:
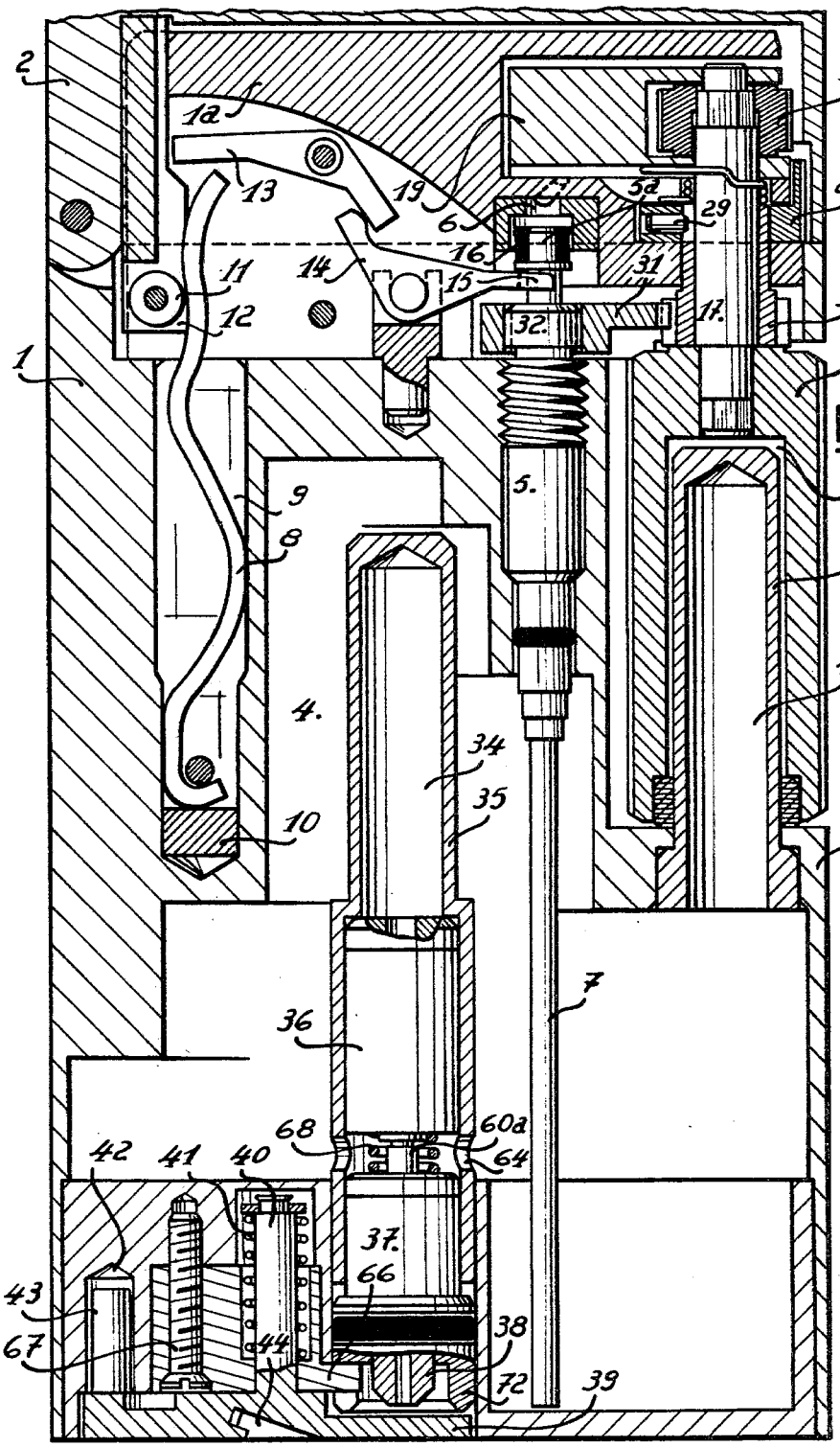

FIG. 10 partially illustrates the lighter when the cover is partially open for replacement of the flint, and FIG. 11 is a view similar to FIG. 3 but showing an alternative form of cigarette lighter in which the gas reserve supply is located within the main reservoir.

The present gas-fired cigarette lighter comprises a gas reservoir, a gas distributor valve and means which make it possible to ignite the gas emerging from this valve. Furthermore, the cigarette lighter comprises a reserve supply of gas which, when the reservoir is empty, can be drained into this reservoir via draining means.

Each embodiment shown in the accompanying drawings is a rechargeable cigarette lighter comprising mechanical gas igniting means.

This cigarette lighter comprises a monobloc body 1, a cover 2 articulated on the body 1 and a roller 3 pivoted on and housed in a recess in the body 1.

As illustrated in FIG. 3, the monobloc body 1 of the cigarette lighter contains a main gas reservoir 4 linked by a valve 5 of known type and mounted in the body 1, to a burner 6 or orifice which delivers the gas when the cover 2 is in a completely open position. A flexible tube or wick 7 links the lower part of the main reservoir 4 with the valve 5.

Figure 4:
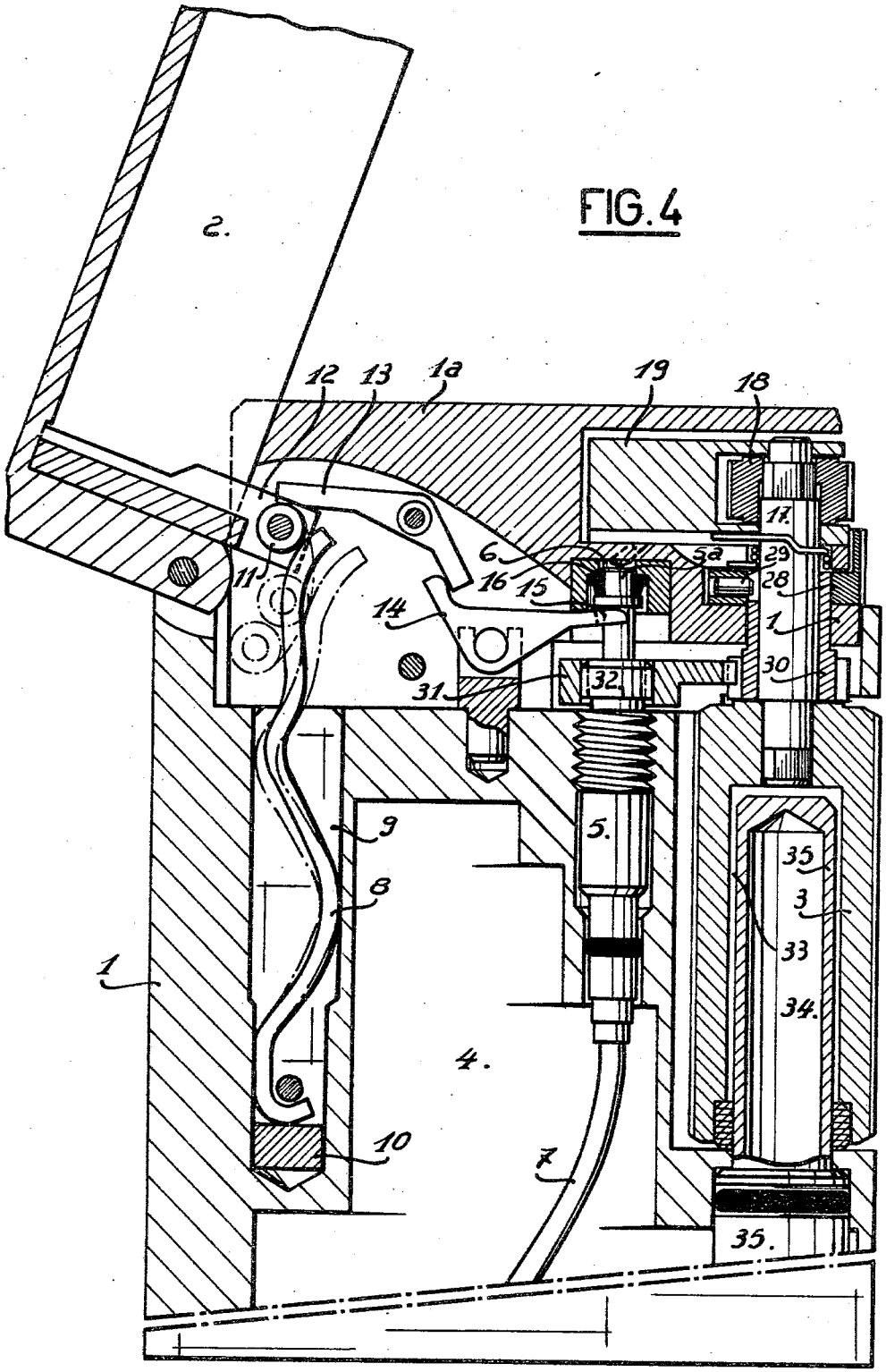
FIG. 4 is a partial view similar to that of FIG. 3 but with the cover in the open position.
Figure 5:
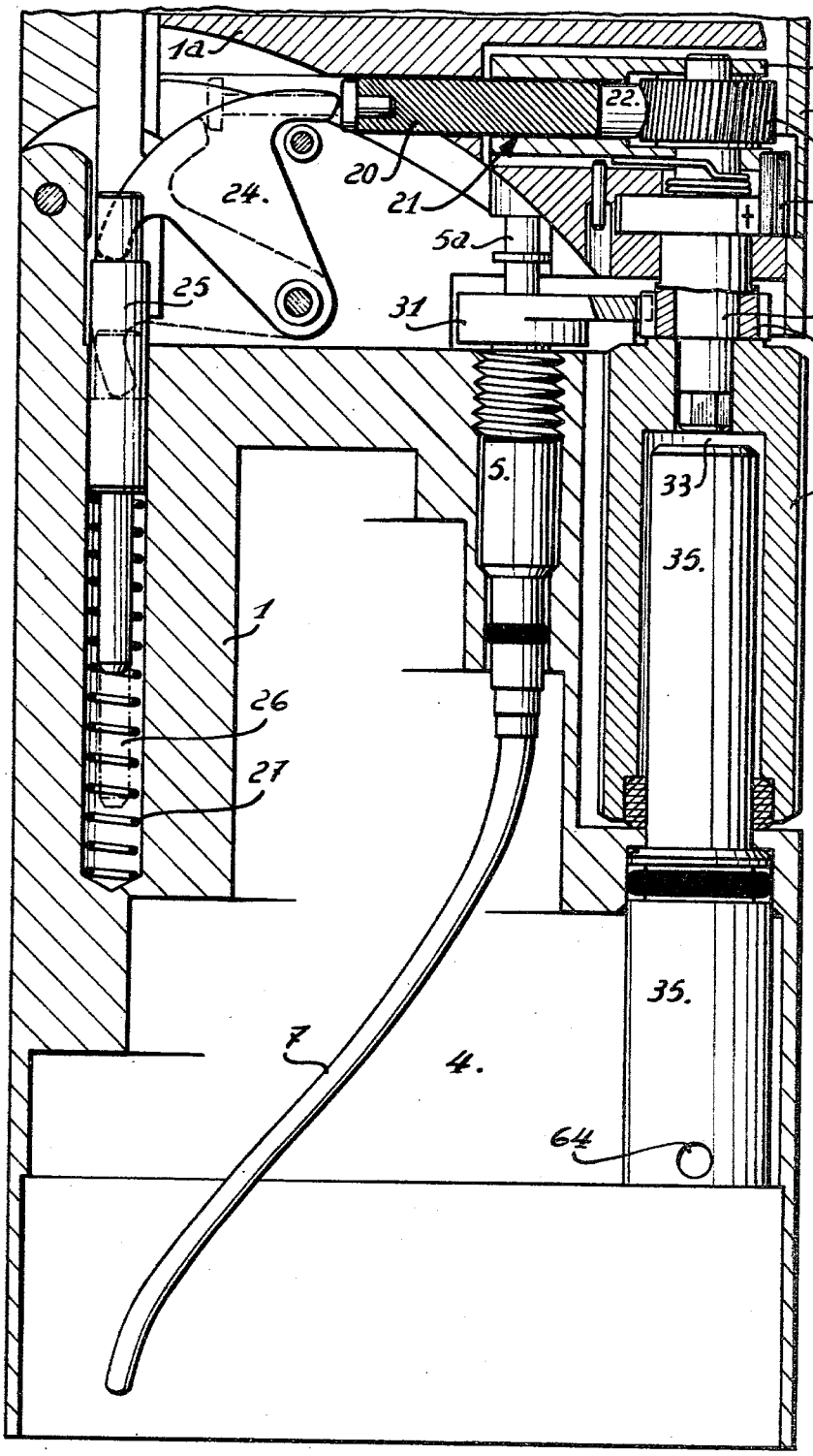
FIG. 5 is a cross-section through the cigarette lighter, through the axis of the roller, the axis of the burner and the axis of the flint pushing device.

The cover 2 is subject to the action of a spring 8 housed in a blind hole 9 in the body and maintained therein by a plunger 10. A wheel 11 pivoted on the cover is applied against the spring 8, the free end of which is of arcuate form so as to maintain the cover either in the closed position (FIG. 3) or in the open position (FIG. 4).

The member 12 carrying the wheel 11 co-operates, in the open position of the cover 2, with a lever 13 pivoted on a plate 1a fixed to the body 1, actuating a rocker 14 likewise pivoted on the body 1 and the free end of which has a fork 15 actuating the valve 5 in order to open it. The part 5a of this valve which is axially sliding is operated by the fork 15. The upper end of this part 5a of the valve is housed in the base of the burner and a seal 16 ensures, when the valve 5 is in the open position, that the emerging gas is indeed all delivered to the burner 6.

It should be noted that the member 12 of the cover 2 operates the lever 13 and thus opens the valve 5 only during the latter part of the opening movement of the cover 2, so that the valve is open only when this cover is fully opened.

A spindle 17, pivoted on the plate 1a carries at its upper end a wheel 18 and is fixed at its lower end to the upper part of the roller 3. A rotation of this roller 3 therefore brings about a rotation of the wheel 18.

This spindle 17 serves as a pivot for a rocking flint carrier 19 maintained in the operative position by a slide-pusher 20. A bore 21 provided in this flint carrier 19 receives a flint 22 which is subject to the action of this slide-pusher 20, the rear end of which abuts against an oscillating segment 24, pivoted on the plate 1a and subject to the action of a piston 25 which slides in a blind bore 26 in the body 1 under the action of a spring 27.

The spindle 17 likewise serves as a pivot for a ring for regulating the height of the flame 28 and accessible when the cover 2 is open. This ring 28, by means of a pin 29, moves a pinion 30 in angular displacements about the spindle 17. The lower part of this pinion 30 engages a toothed segment 31 operating the regulating element 32 of the valve 5.

The roller 3 is axially hollow and has a cavity 33 discharging at its bottom end. This cavity receives a cylindrical chamber 34 constituting a reserve supply of gas and forming part of the filling device.

This filling device comprises a cylindrical casing 35, the upper part of which encloses the reserve supply 34 and the lower part of which incorporates two valves 36, 37. This casing 35 is fixed on the body 1 and serves as a pivot at the bottom end of the roller 3.

Access to the filling connector 38 of the valve 37 is, during normal functioning, occluded by a small plate 39 rigid with a pivot 40 pivoted in the body 1 and subject to the action of a spring 41 which tends to apply this plate against the body 1. This plate 39 likewise, in the normal operating position, occludes a housing 42 in the body which encloses a spare flint 43.

The small plate 39 has a part of small thickness opposite the filling device during normal functioning and a part of considerable thickness occluding the housing 42. An oblique notch 44 makes it possible to operate the plate 39 with the nail, as will be seen hereinafter.

The valve 36 comprises a socket 45 provided in the cylindrical casing 35 and comprising a transverse wall 46 in which there is a bore. A piston 47 is disposed in this socket, its tubular tail 48 traversing the bore in the wall 46 of the socket. A flexible seal 49 is clamped between the piston 47 and the wall 46 and during normal functioning (FIG. 6) occludes two radial passages 50 which provide access to the interior of the hollow tail 48 of the piston.

The tubular connector 51 is housed in the socket 45 and bears against a shoulder 52 of the casing 35. This tubular connector 51 has a skirt 53 engaged in the socket 45 and its bottom end maintains the peripheral part of the seal 49 firmly applied against the wall 46 of the socket 45. A spring 54 bears on the upper annular inner face of the tubular connector 51 and seeks to apply the piston 47 against the seal 49.

The second valve 37 is of the same type and comprises a socket 55 sliding in the casing 35 and a tubular connector 56, of which the skirt 57 extends into the socket 55. The lower end of this skirt 57 is applied to the elastic annular seal 58, which abuts a shoulder of the socket 55. A piston 59 is housed in the socket 55 and tends to be applied against the seal 58 by a spring 60. This piston 59 has an upper rod 60*a* traversing the tubular connector 56 and the upper end of which, of reduced diameter, 61, is seated in the tubular tail 48 of the piston 47 of the valve 36. This tubular tail 48 also has radial bores 62, while the upper rod 60*a* has a flat 63 creating a passage between this rod and the tubular connector 56. The casing 35 comprises bores 64 connecting the interior of this casing 35, between the two valves 36, 37, to the main reservoir 4.

The piston 59 has a tubular tail 65 traversing the seal 58 and the free end of which forms a filling connector 38.

Figure 6:
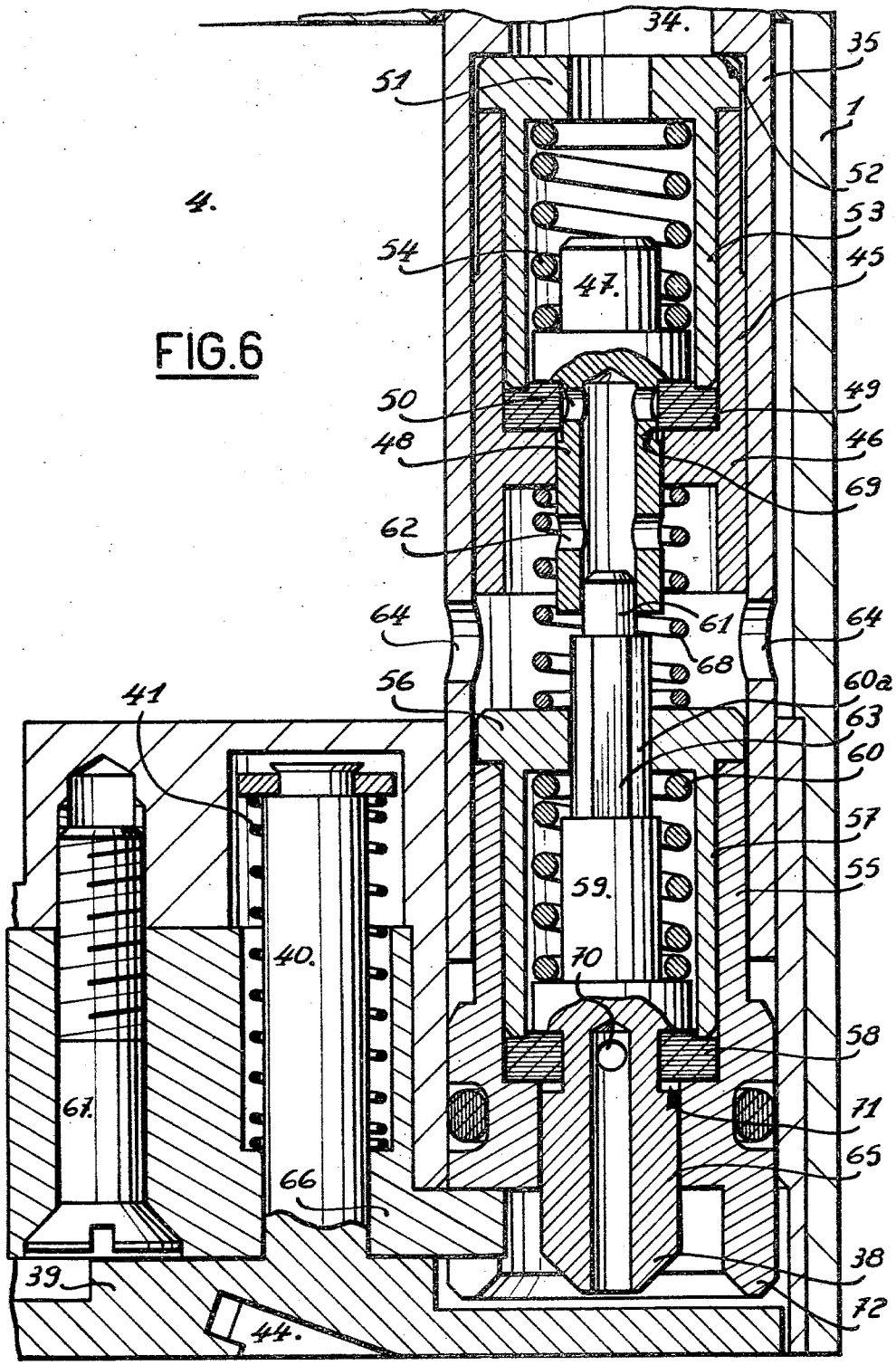
FIGS. 6, 7 and 8 are partial sections and illustrate on an enlarged scale the filling device in the position of normal use of the lighter, in the position of recharging of the reservoir and of the reserve supply and in a position showing transfer of the gas contained in the reserve supply into the main reservoir in the body of the lighter.

An abutment 66 fixed to the body 1 by a screw 67 defines the position of the socket 55 in normal functioning (FIG. 6). Indeed, a spring 68 tends to separate the two valves 36, 37 from each other and applies the valve 36 against the shoulder 52 of the casing 35 and the valve 37 against the stop 66.

When the cigarette lighter is not being used, its elements are in the position illustrated in FIGS. 3 and 6, the cover 2 is closed, which occludes the valve 5 and the valves 36 and 37 are closed, gas being trapped in the main reservoir 4 and in the reserve supply 34.

In order to cause the cigarette lighter to function, the cover is opened, which results in opening of the valve 5 via the lever 13 and the rocker 14, and gas escapes via the burner 6. The user operates the roller 3, rotating it to drive the wheel 18 against the flint 22, creating a spark which ignites the gas.

Closing the cover results in closure of the valve 5 and the flame is extinguished.

Figure 8:
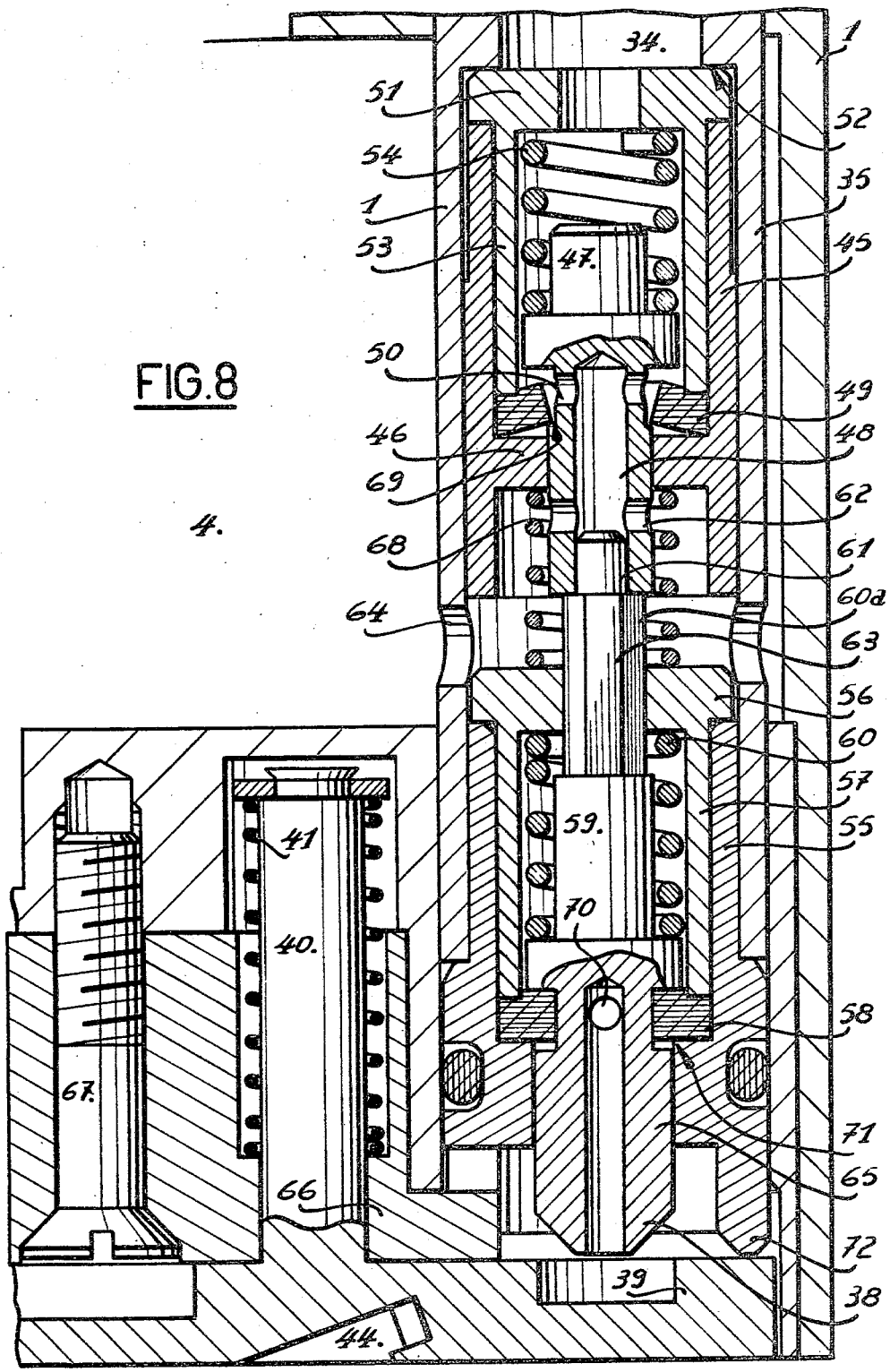

When the main reservoir 4 is empty, the user raises the plate 39, turns it through 180° and presses it strongly against the body of the lighter. The thick part of this plate 39 (FIG. 8) comes in contact with a boss 72 on the socket 55 and causes an axial displacement of the entire valve 37 in the direction of the valve 36. During this displacement, the valve 37 remains closed since there is no relative displacement brought about between the socket 55 and the piston 59.

The large diameter end of the rod 60*a* of the piston 59 abuts against the bottom end of the tubular tail 48 of the piston 47 of the valve 36 and causes an axial displacement of the piston 47 in relation to the socket 45.

The seal 49 becomes deformed under the action of the shoulder 69 and causes the bores 50 to communicate with the reserve supply 34. The gas from this latter flows through the bores 50, the tubular tail 48, the bores 62 and the bores 64 and into the main reservoir 4.

The user replaces the plate 39 to its normal position (FIG. 6), the valve 36 returns to its normal position of closure under the action of the spring 68 and the cigarette lighter is again ready to operate.

The reserve supply of gas contained in the cavity 34 is sufficient for 20 to 50 lightings of the lighter, in other words ample for the user to be able to wait until he has an opportunity of refilling the lighter.

Figure 7:
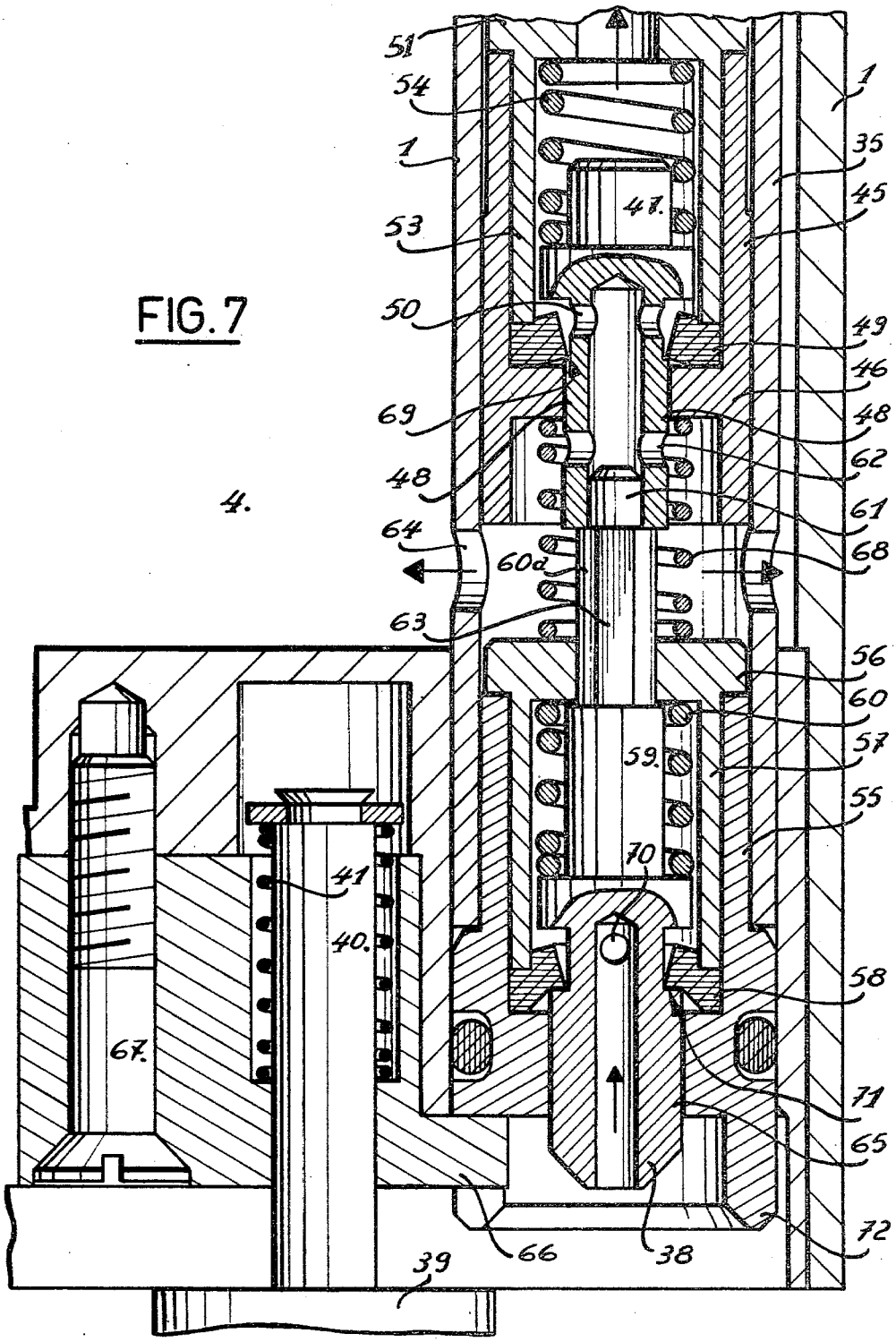

In order to refill the lighter, the user lifts the plate 39 and moves it angularly through 90° (FIG. 7). He then applies the refill container against the connector 38 which this time results not only in opening of the valve 36 as previously but also opening of the valve 37 since there is an axial displacement between the piston 59 and the socket 55. The gas enters through the passage in the connector 38, through the bores 70, the seal 58 being displaced by the shoulder 71, the cavity around the piston 59, the groove 63 and the bores 64 into the main reservoir 4. The gas enters simultaneously through the open valve 36 into the cavity in the reserve supply 34.

When the reservoir 4 and the reserve supply 34 are filled with gas, the user withdraws the refill container, the valves 36 and 37 close again under the action of springs 54, 68 and 60. It is then sufficient to replace the plate 39 to its normal operating position (FIG. 6) for the cigarette lighter to be operational.

Figure 9:
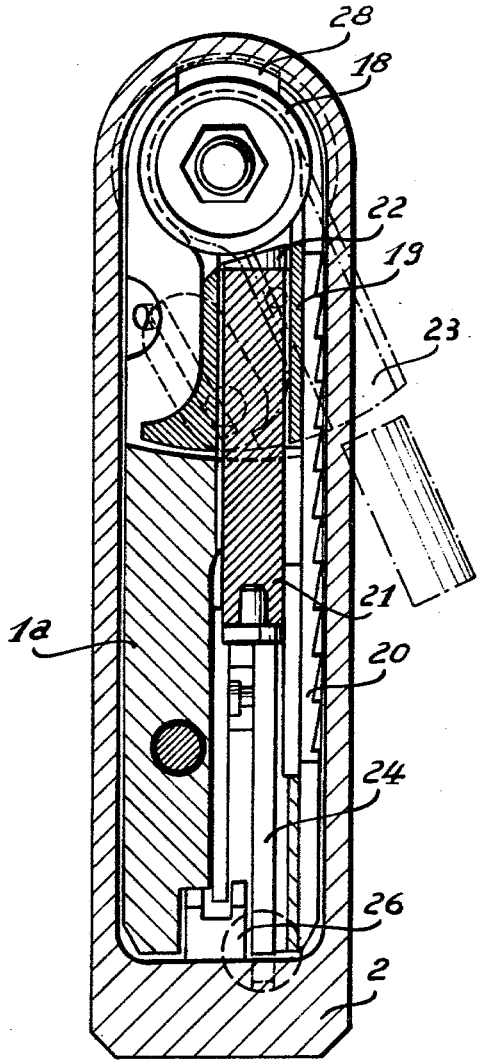
FIG. 9 is a cross-section at the level of the flint pusher.

It should be noted further that to replace a flint 22, the flint carrier 19 (FIG. 9) is displaced angularly after it has been released by withdrawal of the slide-pusher 20, then the cover 2 is partially folded back against the open flint carrier 19 (FIG. 10), which closes the valve 5 and avoids any loss of gas during replacement of a flint.

In alternative embodiments which are not illustrated, the method of ignition might well be different, being for example a piezoelectric or other system.

It is evident that the reserve supply of gas need not be situated in the roller but at some suitable location inside the main reservoir, as illustrated in FIG. 11. In this case, the capacity of the main reservoir may be increased by extending it into a part of the roller, as illustrated. A casing 73 extending inside the roller makes it possible to render the main reservoir fluid-tight. In the example illustrated in FIG. 11, those elements which are to be found also in FIGS. 1 to 10 bear the same reference numerals.

This novel solution, the use of a reserve supply of gas, maybe employed in all types of cigarette lighters, rechargeable or otherwise, having a cover or not, comprising an igniter which may be mechanical, piezoelectric or electronic. The embodiment illustrated and described with reference to FIGS. 1 to 10 is of course given only by way of non-limitative example and is applied more particularly to expensive rechargeable and relatively flat cigarette lighters.

In the case of a non-rechargeable lighter, the use of a reserve supply of gas results in simpler technical solutions. Indeed, there is no longer any need for a double valve (36, 37); it is sufficient to provide means for draining the reserve supply into the main reservoir when this latter is empty. These draining means may be a simple valve, a passage or orifice which is created or opened in the wall of the reserve supply by operating a control element which is accessible from outside.

It goes without saying that various modifications may be made to the device which has just been described solely by way of non-limitative example, by a man skilled in the art, without departing from the framework of the invention.

We claim:

1. A gas-fired cigarette lighter comprising a gas reservoir, a gas distributor valve and means which make it possible to ignite the gas emerging from this distributor valve, at least one reserve supply of gas and means for draining this reserve supply into the gas reservoir, a filling device enabling simultaneous filling of the reserve supply and of the gas reservoir, the filing device comprising two serially disposed valves one of which is situated between the reserve supply of gas and the gas reservoir and the other of which is situated between the gas reservoir and the outside of the lighter, means for simultaneously opening both said valves during filling, and means for opening only said one valve during transfer of gas from said reserve supply to said reservoir.

2. A cigarette lighter according to claim 1, characterised in that the reserve supply and the two valves are mounted in a casing and in that the interior of this casing is linked, between the two valves, to the main reservoir.

3. A cigarette lighter according to claim 2, characterised in that a pivoting plate occludes access to the filling device in the position of normal operation.

4. A cigarette lighter according to claim 3, characterised in that an angular displacement of 180° of this plate and a subsequent displacement thereof axially towards the body produce operation of the element which controls the valve situated between the reserve supply and the other valve.

5. A cigarette lighter according to claim 4, said means to ignite the gas comprising a flint, characterised in that in the position of normal operation the plate occludes a cavity adapted to receive a spare flint.

6. A cigarette lighter according to claim 1, characterised in that the reserve supply of gas is situated inside the gas reservoir.

7. A cigarette lighter according to claim 1, characterised in that it comprises a roller operating means which make it possible to ignite the gas and in that the reserve supply of gas is at least partially housed inside this roller.

8. A cigarette lighter according to claim 1, characterised in that the reserve supply of gas is coaxial with the filling device.

9. A cigarette lighter according to claim 7, characterised in that it comprises a cover articulated on the body, and in that the housing of the roller is situated below the edge of the cover which bears on the body and in that the body is of monobloc construction.

10. A cigarette lighter according to claim 9, characterised in that it comprises an operating connection linking the cover with the distributor valve in such a way that this valve is opened only during the course of the final part of the angular travel performed by the cover as it opens.

11. A cigarette lighter according to claim 10, said means to ignite the gas comprising a flint, characterised in that it comprises an abutment maintaining the cover partially open during installation of a flint, so that the distributor valve is in the closed position during this partially open position of the cover.

12. A cigarette lighter according to claim 7, characterised in that the roller is pivoted at its bottom end on the casing containing the reserve supply of gas and in that its top end is rigid with a spindle pivoted on the body of the cigarette lighter, the other end of which operates means which make it possible to ignite the gas.

13. A cigarette lighter according to claim 12, characterised in that it comprises a device for regulating the height of the flame, the control element of which is pivoted coaxially with this spindle.

14. A cigarette lighter according to claim 12, characterised in that the spindle rigid with the roller carries at its free end a wheel co-operating with a flint housed in a flint carrier.

15. A cigarette lighter according to claim 14, characterised in that the flint carrier is articulated in respect of the body according to a direction at right-angles to that according to which the cover is articulated on this body.

16. A cigarette lighter according to claim 15, characterised in that the flint carrier, when it is in the position needed for fitment of a flint, constitutes an abutment which maintains the cover in the partially open position.

* * * * *